United States Patent [19]

King

[11] Patent Number: 4,762,472

[45] Date of Patent: Aug. 9, 1988

[54] AIR PUMP ASSEMBLIES

[76] Inventor: Peter J. King, P.O. Box 79, Tewantin, Australia, QLD 4565

[21] Appl. No.: 127,619

[22] Filed: Nov. 30, 1987

Related U.S. Application Data

[63] Continuation of Ser. No. 855,585, Apr. 25, 1986, abandoned.

[30] Foreign Application Priority Data

May 2, 1985 [AU] Australia ..... PH0396

[51] Int. Cl.[4] ..... F04B 17/00

[52] U.S. Cl. ..... 417/366; 417/410

[58] Field of Search ..... 417/366, 372, 373, 368, 417/410; 15/413; 310/58

[56] References Cited

U.S. PATENT DOCUMENTS

| | | | |
|---|---|---|---|
| 3,932,070 | 1/1976 | Porter et al. | 417/368 |
| 4,226,575 | 10/1980 | Hyatt et al. | 417/368 |
| 4,518,325 | 5/1985 | Kingston | 417/368 |

*Primary Examiner*—Carlton R. Croyle
*Assistant Examiner*—Timothy S. Thorpe
*Attorney, Agent, or Firm*—Murray and Whisenhunt

[57] ABSTRACT

The invention resides broadly in an air pump assembly including an electric motor operatively connected to an air pump having an outer casing provided with pump inlet and outlet means; an outlet chamber communicating with said pump outlet means and having a supply outlet through which pumped air may be fed to an air supply line and manifold means associated with said electric motor for ducting cooling air directly from the motor for discharge remote from the air flow path to said pump inlet means.

12 Claims, 5 Drawing Sheets

AIR PUMP ASSEMBLIES

This application is a continuation of Ser. No. 855,585, filed Apr. 25, 1986, now abandoned.

This invention relates to improved air pump assemblies.

Various types of air pump assemblies are presently used for supplying air to spa pools and the like. Mostly they utilize a stock centrifugal pump which has an integral electric motor and impeller which are supported within a suitable casing. These centrifugal pumps are arranged within suitable housings whereby a relatively large volume of air may be supplied to a spa pool or the like to cause aeration of the pool water. The centrifugal pump may be an axial flow unit ot a bypass unit. In the axial flow units the air flows through the impeller to the motor. This air flow is utilized to cool the motor. In the bypass units the electric motor and the impeller are each provided with respective air inlets and air outlets. These have been developed to overcome the disadvantage associated with axial flow units that the air is preheated prior to passage as it passes through the electric motor.

While the bypass units are provided with separate air inlets and outlets for the motor and the impeller much difficulty has been experienced in the past in providing housings which maintain separate air flow paths in use, and in particular separation between the inlet to the impeller assembly and the air outlet from the motor. Accordingly, the advantage of the separate inlets and outlets is often not fully utilized as many air pumps have simple housings in which the exhaust from the electric motor is fed into a top housing portion from which air for both the motor and the impeller is drawn. A disadvantage of these types of air pumps and those utilizing axial flow units is that upon initial start-up of the air pump assembly the air supply line from the air pump assembly to the spa pool may be partly filled with water and this line has to be purged before the air can flow through the air pump assembly. This leads to the motor overheating and frequently use can cause premature failure of the motor. Similarly if the or some of the outlets are blocked, the air flow will decrease and the motor will overheat.

Most prior designs which have attempted to achieve the desired air path separation mount the motor and impeller in separate housings and provide separate inlets and exhausts from the respective housings. This results in a relatively complex housing assembly. Furthermore inefficiencies occur as a result of the exhaust from the motor heating up the dividing wall between the impeller and motor housings and thus increasing the temperature of the air being pumped by the impeller assembly. Of course in this respect the pumping efficiency is reduced with increases in temperature and thus the prior art arrangements may operate inefficiently, especially during periods of high ambient temperature. Furthermore such air pump assemblies are often mounted in an exposed position and in direct sunlight. This causes further inefficiencies in operation with the result that the presently available air pump assemblies for spas frequently overheat and thus have a relatively short service life.

A typical prior art air pump assembly is shown in U.S. Pat. No. 4,518,325 in the name of James E. Kingston. As can be seen the motor and impeller unit is mounted with its axis vertical and with separate air inlets and outlets for the impeller and the motor. However it will be seen that the hot air exhausted from the motor assembly is exhausted into a housing which encases the motor before it passes into the outlet chamber formed by arranging a U-shaped gasket between the upper shroud and the bottom end portion of the top housing section. Thus the hot exhaust air from the motor will heat up the housing across which all incoming air for the motor cooling must pass and the motor always operates in a relatively hot environment. This of course reduces the efficiency of the cooling air.

The motor exhaust air also heats up the partition wall dividing the motor from the impeller and thus it increases the temperature of the air within the impeller. This further reduces the efficiency of operation of the assembly. It will also be seen that a relative complex housing assembly is required to provide the desired isolation between the motor and the impeller. This adds to the cost of production of the pump assembly and to the difficulty of servicing the motor.

The present invention aims to alleviate the abovementioned disadvantages and to provide an air compressor assembly which will be reliable and efficient in use. Other objects and advantages of this invention will hereinafter become apparent.

With the foregoing and other objects in view, this invention in one aspect resides broadly in an air pump assembly including an electric motor operatively connected to an air pump having an outer casing provided with pump inlet and outlet means; an outlet chamber communicating with said pump outlet means and having a supply outlet through which pumped air may be fed to an air supply line and manifold means associated with said electric motor for ducting cooling air directly from the motor for discharge remote from the air flow path to said pump inlet means.

The air pump assembly may include an outer housing having a base wall providing a mounting thereon for said outlet chamber. The base wall may be provided with air intake means through which air may be supplied to said motor and impeller unit. A common air intake may be utilized so as to maintain the simplicity of construction of the air pump housing. If desired separate air intakes may be formed in the base wall for the motor and for the impeller respectively and dividing walls may be used to provide the separate air flow paths. Preferably the manifold means is adapted to discharge air through the base wall in such manner that the discharged air is directed away from the air inlet. The outer housing may include a weatherproofing cover which fits over the base wall whereby the air intakes and the air outlets in the base wall are concealed from rain water and the like when utilized in an external installation. Of course for internal applications the air intakes could be arranged in the side wall or elsewhere in the cover.

In a preferred embodiment a common air intake is provided for the motor and for the impeller in the base wall of the outer housing and baffle means, which may be separate from or associated with or constituted by the plenum chamber, are provided to operatively divide the lower part of the outer housing into a first part in which the motor is supported and a second part containing the air inlet to said impeller. Preferably the first and second parts are adapted to communicate across the top of said baffle means and for this purpose the top of the weatherproofing cover is shaped to provide a substantially unrestricted air flow path across the top of the baffle means.

Preferably the outlet chamber is formed from a plastics material having a low thermal conductivity and the supply outlet thereof is in the form of a socket connection whereby the outlet chamber may be supported on the end of an upstanding pipe through which air is adapted to be supplied from the air pump assembly. The outlet chamber may be so made and arranged that it will engage firmly about the impeller casing and support the motor at one side thereof in a cantilever manner.

The manifold means may comprise one or more manifolds each sealably connected to a respective outlet port of the motor and adapted to convey hot exhaust air through the base wall. The latter may be provided with sound insulation means which extends about all intake ports so as to muffle air flow noises. These may be minimised by providing a simple air flow path to the impeller. It is also preferred that the exhaust manifolds be formed from a plastics material having a low thermal conducitivity. The exhaust manifolds may be glued or otherwise sealably connected to the motor. Of course the outlet chamber and the manifolds may be made of metal if desired. The exhaust manifold may be adapted to discharge through a side wall on the top of the housing if desired, especially for indoor applications. Features of this invention can be used advantageously to form a pump assembly utilizing an axial flow pump unit or separate motor and impeller units if desired.

This invention also resides in an air pump assembly including: an outlet chamber having an air outlet connection whereby the chamber may be supported on an upstanding air supply pipe; support means for operatively supporting an air pump whereby the air pumped thereby is fed to said outlet chamber; a mounting on said outlet chamber and an outer cover within which said air pump may be contained and being detachably securable to said mounting.

In order that this invention may be more readily understood and put into practical effect, reference will now be made to the accompanying drawings which illustrate preferred embodiments of the present invention and wherein.

Figure 1:
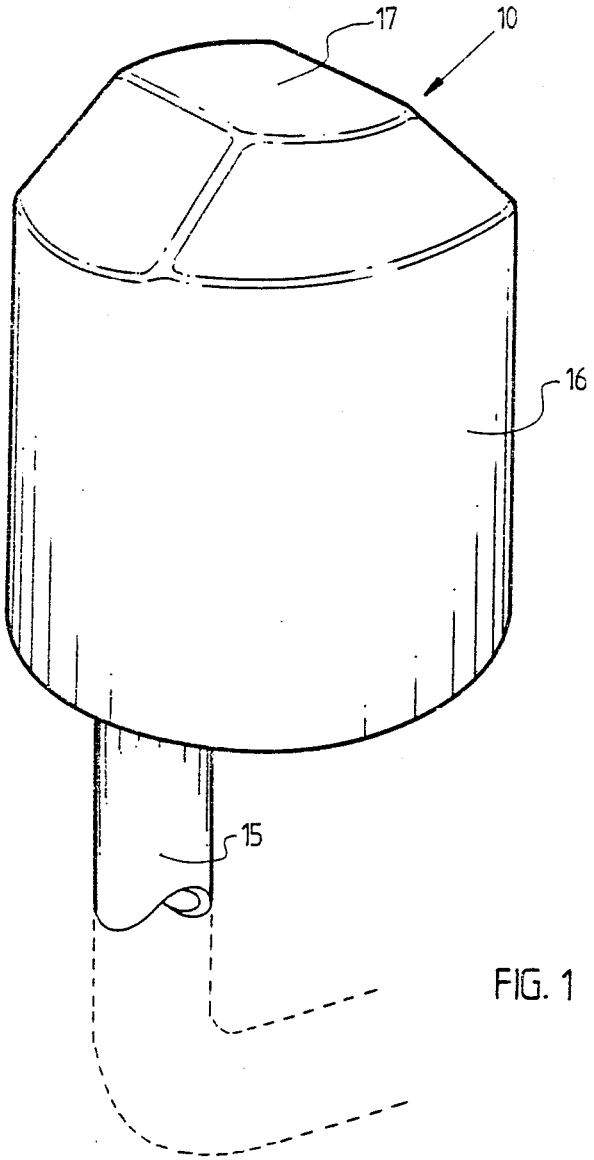
FIG. 1 is a perspective view of one form of air pump assembly.
Figure 2:
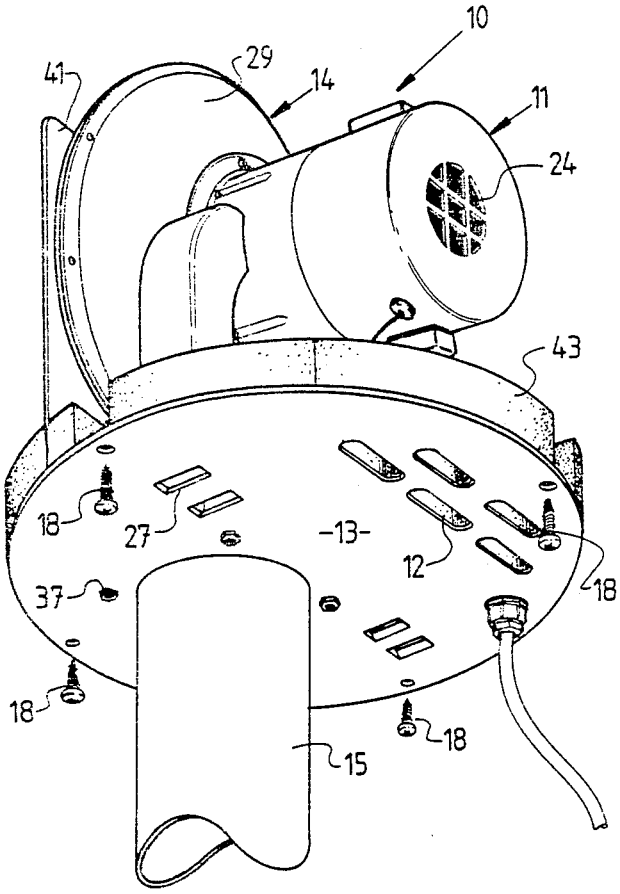
FIG. 2 is an underneath perspective view of the air pump assembly shown with the top cover removed.
Figure 3:
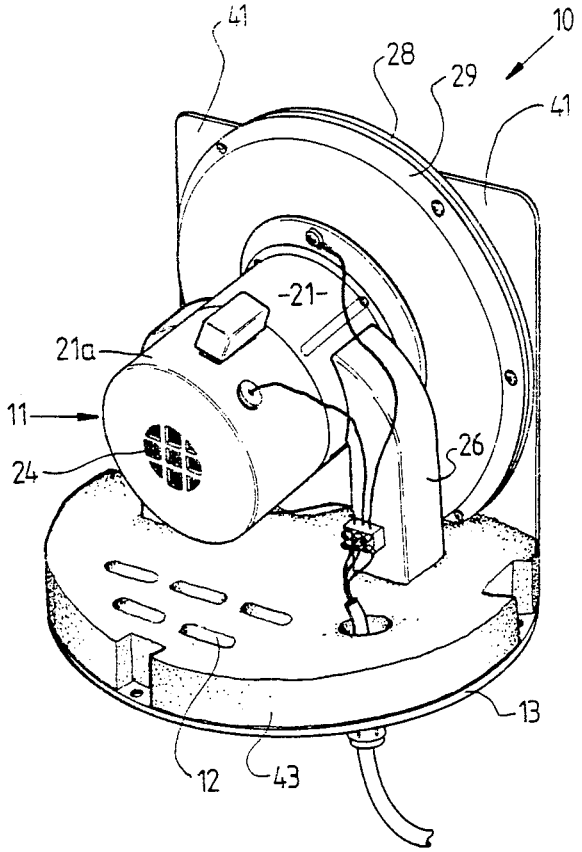
FIG. 3 is a top perspective view of the pump assembly shown with the top cover removed.

Referring initially to FIGS. 1 to 4 there is shown an air pump assembly 10 which utilizes a bypass type motor/impeller unit 11 to pump air from air inlets 12 arranged in the base wall 13 of the assembly through the plenum chamber assembly 14 and out through a supply conduit 15. A one piece top cover 16 having a raised crown portion 17 extends about the pump assembly and downwardly beyond the circular base wall 13. Locking screws 18 are adapted to pass through the base wall 13 into the locking lower peripheral portion of the cover 16 to secure the cover 16 thereto.

Figure 4:
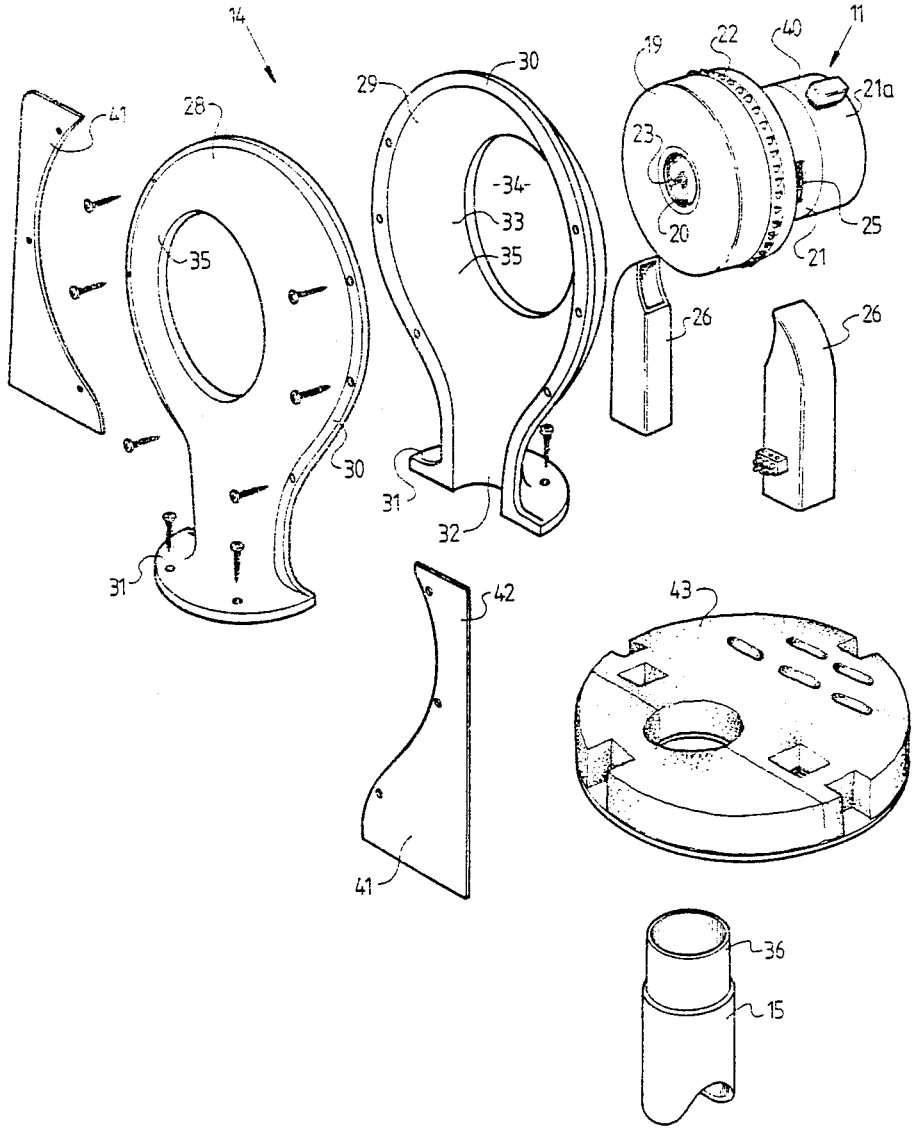
FIG. 4 is an exploded view of the major components of the air pump assembly.

As can be clearly seen in the exploded view in FIG. 4 the motor/impeller unit 11 includes a first relatively large diameter cylindrical impeller casing 19 in which the impeller 20 is mounted and an integral smaller diameter cylindrical motor casing 21 in which the motor is mounted. The impeller casing 19 is provided with a plurality of spaced peripheral outlet ports 22 disposed centrally around its outer surface and an air inlet 23 in the end wall thereof remote from the motor casing 21. The latter is also provided with a central air inlet 24 in its end wall remote from the impeller casing 19 and outlet ports 25 at opposite sides of the motor casing 21. The outlet ports 25 communicate with respective exhaust manifolds 26 which are adapted to be sealably connected to the side of the motor casing 21 to convey exhaust air therethrough for discharge through outlet ports 27 in the base wall 13. The side walls of the outlet ports 27 incline outwardly so that exhaust air is deflected away from the inlet ports 12.

In this embodiment the plenum chamber assembly 14 comprises a pair of similar dished housing parts 28 and 29 which engage sealably together around central flanges 30. The housing parts 28 and 29 each have a flanged base mounting part 31 extending about a part circular passage 32 which communicates with the annular chamber parts 33 formed about the central opening 34 provided in the side walls 35 of the dished housing parts 28 and 29. The part passages 32 of each housing 28 and 29 are adapted to form an inlet socket in which the upper reduced end portion 36 of the supply conduit 15 may engage to support the plenum chamber 14. The base wall 13 is connected to the flanged base 31 by through bolting as shown at 37.

The circular central openings 34 in the end walls 35 of the plenum chamber 14 are adapted to engage tightly about the impeller casing 19 at opposite sides of the row of outlet ports 22. A mastic or sealant or the like may be used to secure the impeller casing in position if desired. The motor casing 21 extends from one side of the plenum chamber assembly 14 whereby the end cap 40 of the motor is accessible and freely removable for servicing the motor brushes or the like.

A pair of baffle plates 41 are adapted to be screwed to opposite sides of the plenum chamber assembly 14 so as to separate the chamber portion containing the impeller inlet 23 from the chamber portion containing the air inlet 12 and the exhaust ports 27. The side portions 42 of the baffles 41 are adapted to lie closely adjacent the side walls of the top cover 16 when it is operatively positioned and to terminate in spaced relationship with the crown portion 17 so that air may flow freely from the inlets 12 across the top of the baffles 41 and down to the impeller inlet 23. This air flow path is shown diagrammatically in FIG. 5. A sound attenuating pad 43 is supported above the base wall 13 and it is provided with through passages which communicate with the air inlet ports 12 and the exhaust ports 27.

From the above it will be seen that the air pump assembly 10 of the present invention is of very simple construction and can be formed from parts which can be easily and economically constructed. Furthermore separate air flow paths are provided for the motor and impeller such that hot exhaust air from the motor will pass directly to atmosphere remote from the air inlet ports 12. Thus cooling of the motor will continue even if all or some of the pump outlets are blocked. The top cover 16 which is a simple one piece moulding can be easily removed to provide access to the motor and impeller assembly. The motor can be easily serviced by removing the end cap 40. Furthermore in use if pool water is accidentally or inadvertently diverted to the air supply conduit 15 the water will flow into the impeller housing and out through the air inlet 23 into the interior of the housing from where it will drain about the periphery of the base wall 13. Thus water will not pass through the shaft bearing of the motor and into the motor. This will prevent undue wear occurring and it will also prevent the possibility of a person in a pool receiving an electric shock through back up of water within the air supply conduit 15 and in contact with the motor electrics.

The air pump assembly 10 is also easy to service since access to the motor brushes can be gained upon removal of the top cover 16 and then removal of the motor's end cap 21*a*. In this respect it will be seen that the exhaust manifolds 26 are spaced from the end cap 21*a* and do not have to be removed for general maintenance and servicing.

Figure 5:
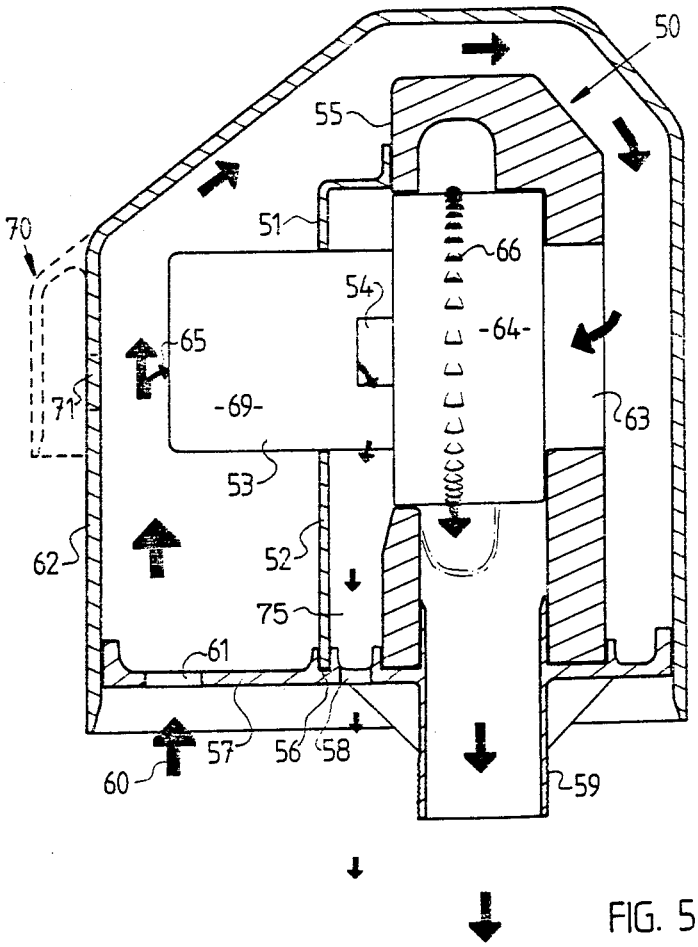
FIG. 5 is a cross-sectional view of an alternate embodiment of the invention and illustrating the air flow paths therethrough.

In the embodiment illustrated in FIG. 5 the plenum chamber assembly 50 is formed as a one piece moulding from a foam plastics material or the like and the exhaust manifold 51 is in the form of a flanged cowl 52 which is adapted to extend about the motor casing 53 and the outlet ports 54 therein and to engage sealably with the adjacent side face 55 of the plenum chamber assembly 50. The cowl 52 also engages sealably with a recess 56 in the base wall 57 and the outlet ports 58 are provided in the base wall 57 so as to communicate with the manifold chamber 75 formed between the cowl 52 and the plenum chamber assembly 50. The base wall 57 is provided with a tubular spigot mount 59 adapted for connection to an upstanding air supply pipe.

All air intake, as shown by arrows 60, is through the inlet ports 61 in the base wall 57. The air travels upwards through the ports 61 inside the cover 62, between the top of the plenum chamber 50 and the crown of the cover 62 and down to the inlet 63 to the impeller casing 64. A small proportion of the air is drawn through the motor 69, as shown by arrows 65. This air flows from the outlet ports 54 through the exhaust manifold 51 and is discharged through the outlet ports 58. The bulk of the air is forced from the impeller casing 64, through the outlets 66 therein, into the plenum chamber for supply through the tubular mounting spigot 59.

An alternate air inlet assembly 70 is shown in dotted outline. This utilizes a port 71 in the side wall of the cover 62 having a weatherproofing hood 72 thereabout. Of course a further inlet could be formed in the cover adjacent the impeller inlet 63.

It will of course be realised that the above has been given only by way of illustrative example of the present invention and that all modifications and variations thereto as would be apparent to persons skilled in the art are deemed to fall within the broad scope and ambit of the present invention as is defined in the appended claims.

I claim:

1. In an air pump assembly of the type having an electric bypass type air pump mounted within a casing for supplying air to an air delivery line, said electric bypass type air pump having a centrifugal pump provided with a pump outlet and a pump inlet and an integral electric driving motor having separate cooling air inlet and outlet apertures remote from said centrifugal pump through which cooling air is forced, the improvement consisting of:

(a) said casing comprising a fixed mounting wall on which said air pump is mounted and a removable cover which connects to said mounting wall and encloses said air pump;

(b) said casing being provided with air intake means adjacent the cooling air inlet aperture for said motor and through which air may pass to said air inlet aperture and to said pump inlet;

(c) there being provided a pumped air chamber assembly extending about said pump outlet having a supply outlet externally of said casing for connection to said air delivery line, and (d) there being provided a motor exhaust chamber fitted to said motor to receive exhausted motor cooling air and having a discharge outlet externally of said casing and spaced from said air intake means, whereby exhausted motor cooling air is discharged directly to the exterior of said casing.

2. An air pump assembly according to claim 1, wherein said pumped air chamber and said exhaust chamber communicate with the respective said supply outlet and said discharge outlet through said mounting wall.

3. An air pump assembly according to claim 2, wherein said pumped air chamber is fixed rigidly to said mounting wall and supports said air pump.

4. An air pump assembly according to claim 3, wherein said exhaust chamber comprises a duct which extends between said motor outlet aperture and said mounting wall.

5. An air pump assembly according to claim 4, wherein said air intake means is formed in said mounting wall.

6. An air pump assembly according to claim 5, wherein there is provided baffle means fixed to said mounting wall so as to divide the portion of said casing adjacent said mounting wall into a primary chamber containing said air intake means and said motor and a secondary chamber containing said pump inlet.

7. An air pump assembly according to claim 6, wherein said pumped air chamber and said exhaust chamber are formed from thermally insulating material.

8. An air pump assembly according to claim 1, wherein said supply outlet includes a mounting connectable to an upstanding air supply line for supporting said pumped air chamber, said centrifugal pump being supported by said pumped air chamber with its impeller axis substantially horizontal and with its motor supported in cantilever manner from said pumped air chamber.

9. In an air pump assembly of the type having an electric bypass type air pump mounted within a casing for supplying air to an air delivery line, said electric bypass type air pump having a centrifugal pump provided with a pump outlet and a pump inlet and an integral electric driving motor having separate cooling air inlet and outlet apertures remote from said centrifugal pump through which cooling air is forced, the improvement consisting of:

(a) said casing comprising a fixed mounting wall on which said air pump is mounted and a removable cover which connects to said mounting wall and encloses said air pump;

(b) said casing being provided with air intake means through said fixed mounting wall through which air may pass to said motor air inlet aperture and said pump inlet;

(c) there being provided a pumped air chamber assembly extending about said pump outlet and having a supply outlet externally of said casing for connection to said air delivery line;

(d) there being provided a motor exhaust chamber fitted to said motor to receive exhausted motor cooling air and having a discharge outlet externally of said casing and spaced from said air intake means; and (e) said exhaust chamber comprising duct means connected between said motor outlet aperture and said mounting wall for discharging exhausted motor cooling air directly to the exterior of said casing remote from said air intake means.

10. An air pump assembly according to claim 9, wherein said pumped air chamber is fixed rigidly to said mounting wall and supports said air pump.

11. An air pump assembly according to claim 10, wherein said exhaust chamber is formed from a thermally insulating material.

12. An air pump assembly according to claim 10, wherein said pumped air chamber assembly has an air outlet connection for supporting said pumped air chamber assembly on an upstanding air supply pipe.

* * * * *